US010240733B2

(12) United States Patent
Tu

(10) Patent No.: US 10,240,733 B2
(45) Date of Patent: Mar. 26, 2019

(54) SOLAR DECORATIVE LIGHT

(71) Applicant: Xingze Tu, Fujian (CN)

(72) Inventor: Xingze Tu, Fujian (CN)

( * ) Notice: Subject to any disclaimer, the term of this patent is extended or adjusted under 35 U.S.C. 154(b) by 10 days.

(21) Appl. No.: 15/587,411

(22) Filed: May 5, 2017

(65) Prior Publication Data

US 2018/0045389 A1 Feb. 15, 2018

(30) Foreign Application Priority Data

Aug. 11, 2016 (CN) ..... 2016 2 0866262 U

(51) Int. Cl.

| | |
|---|---|
| ***F21S 9/03*** | (2006.01) |
| ***A41G 1/00*** | (2006.01) |
| ***F21S 4/22*** | (2016.01) |
| ***F21S 4/10*** | (2016.01) |
| ***F21V 23/00*** | (2015.01) |
| *F21Y 115/10* | (2016.01) |
| *F21W 121/00* | (2006.01) |

(52) U.S. Cl.

CPC ..... *F21S 9/032* (2013.01); *A41G 1/005* (2013.01); *F21S 4/22* (2016.01); *F21V 23/003* (2013.01); *F21W 2121/00* (2013.01); *F21Y 2115/10* (2016.08)

(58) Field of Classification Search

CPC ..... F21S 9/03–9/037; F21S 4/00–4/26; F21W 2121/00; A41G 1/001; A41G 1/004; A41G 1/005

See application file for complete search history.

(56) References Cited

U.S. PATENT DOCUMENTS

| | | | | |
|---|---|---|---|---|
| D351,915 | S * | 10/1994 | Hermanson | D26/25 |
| 2003/0043579 | A1* | 3/2003 | Rong | F21V 3/02 362/237 |
| 2005/0207150 | A1* | 9/2005 | Cheng | A41G 1/005 362/227 |
| 2006/0221614 | A1* | 10/2006 | Van Dyn Hoven | F21V 3/04 362/249.16 |
| 2007/0171634 | A1* | 7/2007 | Kao | F21S 9/032 362/192 |
| 2009/0052168 | A1* | 2/2009 | Chen | A41G 1/005 362/122 |
| 2010/0008077 | A1* | 1/2010 | Ponamar | F21S 9/032 362/183 |

FOREIGN PATENT DOCUMENTS

| | | | | |
|---|---|---|---|---|
| GB | 2519352 A * | 4/2015 | ..... | F21S 9/03 |

* cited by examiner

*Primary Examiner* — Mariceli Santiago

(57) ABSTRACT

A solar decorative light having decorative flowers and a light string; the light string includes a transparent wire and multiple LED light beads; the transparent wire connects the LED light beads in series; the transparent wire twines the decorative flowers, with each of the LED light beads being positioned on a surface of a respective decorative flower.

3 Claims, 3 Drawing Sheets

SOLAR DECORATIVE LIGHT

BACKGROUND OF THE INVENTION

The present invention relates to the field of lighting equipment, and more specifically relates to a solar decorative light Decorative light is a decorative lighting equipment generally used for creating and enhancing indoor atmosphere. Decorative lights in the market have various designs, one of which being a flower shape decorative light, which includes multiple decorative plastic flowers designed according to different flower species and light beads mounted on the decorative plastic flowers. The decorative plastic flowers are plural in number, and each of the decorative plastic flowers is directly installed with a respective light bead. When the light beads are lighted up, the lights emitted from the light beads illuminate on the decorative plastic flowers to create and enhance the surrounding atmosphere.

However, this kind of decorative light requires a hole to be opened on each decorative plastic flower to sleeve a light bead. Furthermore, a large quantity of decorative plastic flowers may be used to maximize the aesthetic value of the decorative light. Therefore, each flower has to be processed during production, and this in turns complicates the manufacturing procedures and increases the production costs. Also, installing the light beads to the flowers imply repeated actions of installation over and over again until all the flowers are installed with the light beads. As such, the decorative light requires tedious processing steps and complicated manufacturing procedures.

BRIEF SUMMARY OF THE INVENTION

An object of the present invention is to provide a solar decorative light which has simple structure and low production cost.

A solar decorative light, comprising decorative flowers and a light string; the decorative flowers are plural in number; the light string comprises a transparent wire and multiple LED light beads; the transparent wire connects the LED light beads in series; the transparent wire twines the decorative flowers, with each of the LED light beads being positioned on a surface of a respective decorative flower.

The solar decorative light also comprises a solar battery panel and a storage cell; the solar battery panel is mounted outside of the decorative flowers; an output end of the solar battery panel is electrically connected with an input end of a control chip; an output end of the control chip is electrically connected with the light string; the control chip and the storage cell are bidirectionally electrically connected.

The decorative flowers are made of plastics, metals or glasses.

The solar decorative light also comprises a shell for fixing the solar battery panel; the solar battery panel is mounted on an outer side surface of the shell; the storage cell and the control chip are mounted inside the shell.

By adopting the above structures, the present invention has the following advantages: the LED light beads are positioned directly via twining of the transparent wire, therefore, the LED light beads can be positioned on the decorative flowers without processing the decorative flowers, thereby saving processing procedures and lowering the production cost. Besides, the present invention is easy and convenient to install and uninstall.

1: light string; 2: decorative flowers; 3: transparent wire; 4: LED light beads; 5: shell; 6: control chip; 7: solar battery panel.

DETAILED DESCRIPTION OF THE INVENTION

The present invention is further described in detail below with reference to an embodiment.

Figure 1:
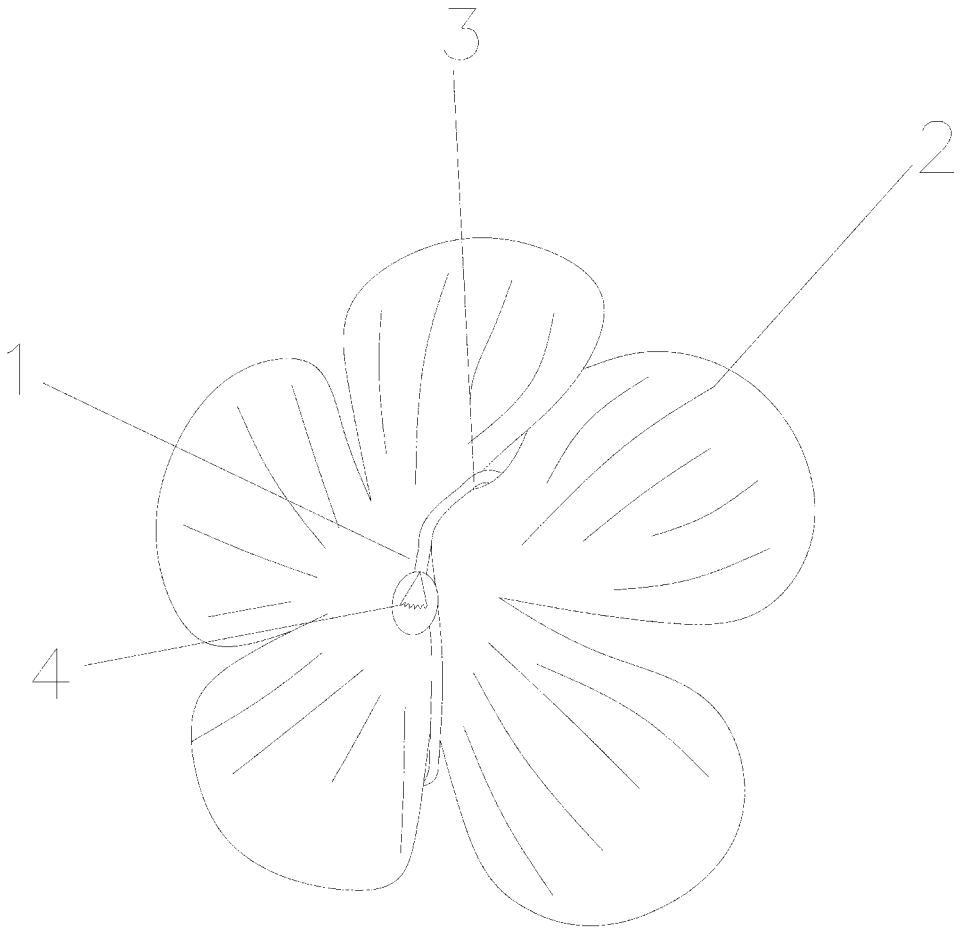
FIG. 1 is a structural diagram of one of the decorative flowers of the present invention.
Figure 2:
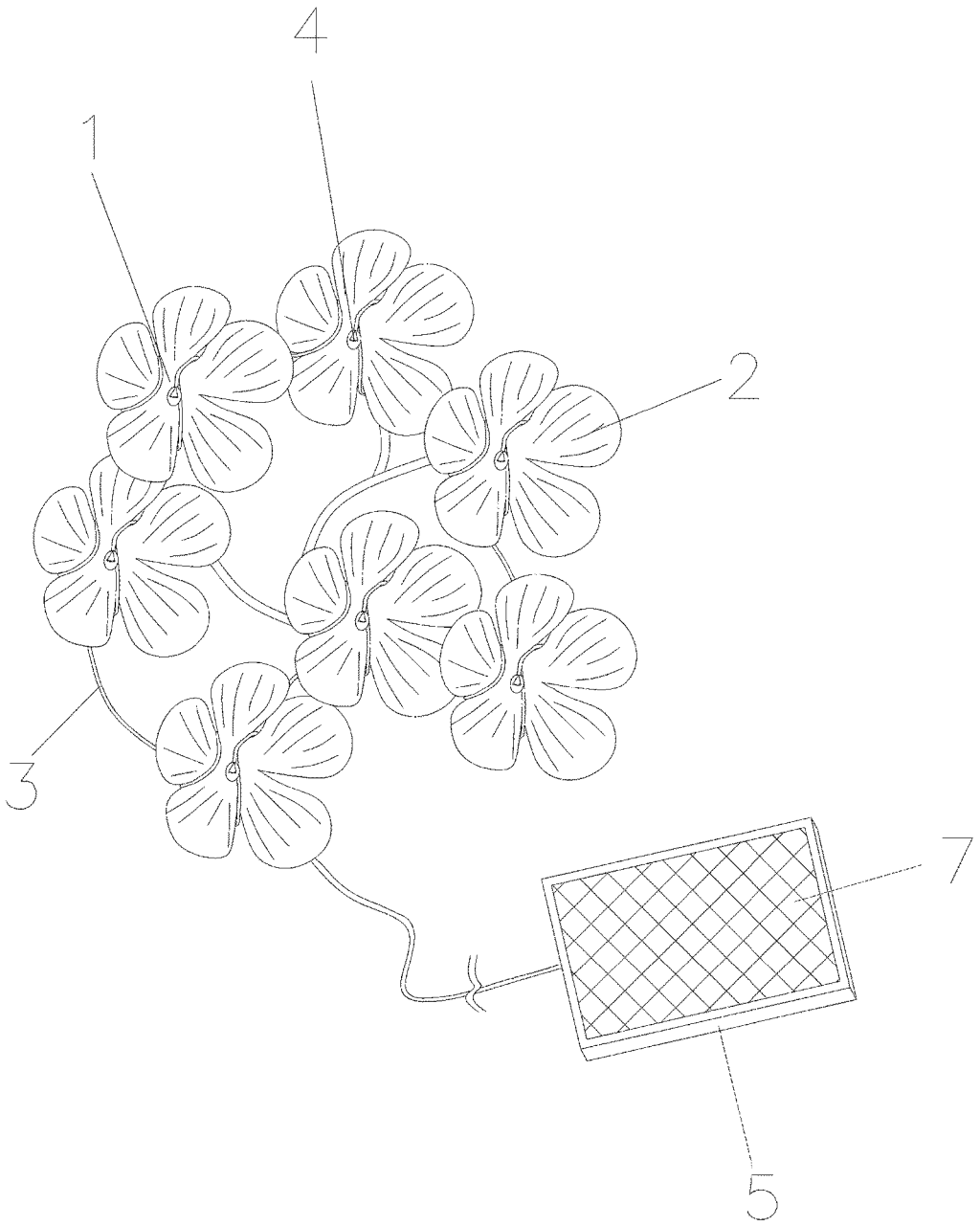
FIG. 2 is a structural diagram of the present invention.
Figure 3:
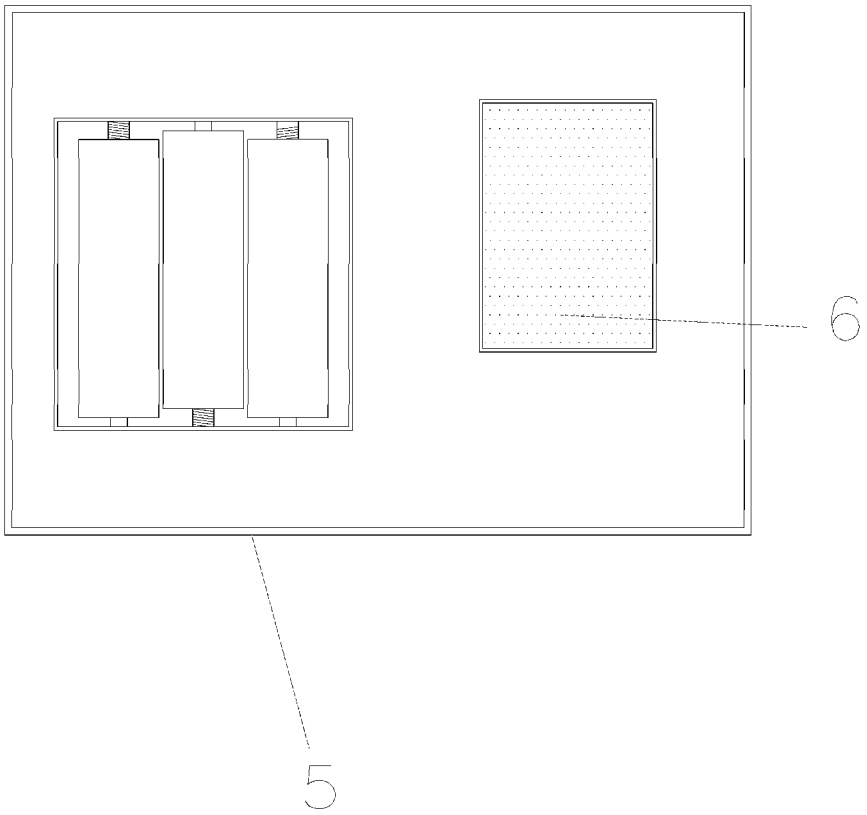
FIG. 3 is a schematic diagram showing the structures inside the shell (wires omitted).
Figure 4:
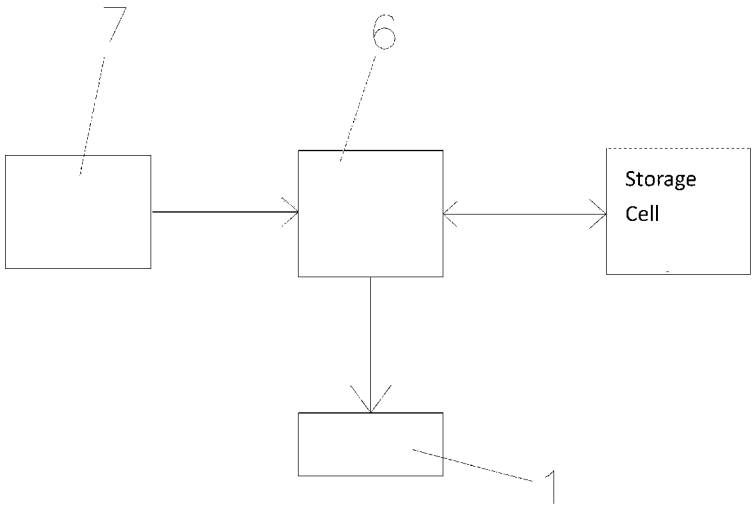
FIG. 4 is a schematic diagram showing electrical connection of the present invention.

The present invention is a solar decorative light. As shown in FIGS. 1-4, the solar decorative light comprises decorative flowers 2 and a light string 1; the light string 1 comprises a transparent wire 3 and multiple LED light beads 4; the transparent wire 3 connects the LED light beads 4 in series; the decorative flowers 2 are plural in number; the transparent wire 3 twines the decorative flowers 2, with each of the LED light beads 4 on the light string 1 being positioned on a surface of a respective decorative flower.

Specifically, each of the decorative flowers 2 comprises multiple petals, and a gap exists between every two adjacent petals; the transparent wire 3 twines the decorative flowers 2 by passing through gaps existing between the petals of each of the decorative flowers, with each of the LED light beads 4 being positioned on an outer surface of a respective decorative flower. In the present embodiment, the decorative flows 2 are made of plastics.

Further, the decorative light of the present invention is solar powered. Therefore, the decorative light also comprises a solar power assembly which comprises a solar battery panel 7, a control chip 6, a storage cell, and a shell 5 for accommodating the solar battery panel 7, the control ship 6 and the storage cell; an interior side of the shell 5 is a cavity, and the shell 5 has an elongated shape; the control chip 6 and the storage cell are mounted in the cavity; the solar battery panel 7 is mounted on an outer side surface of the shell 5; the control chip 6 and the storage cell are bidirectionally electrically connected; an output end of the solar battery panel 7 is electrically connected with an input end of the control chip 6; an output end of the control chip 6 is electrically connected with the light string 1. The solar battery panel 7 is used for absorbing sunlight and converting the sunlight into electricity; the electricity charges the storage cell via the control chip 6. During use, the storage cell supplies electricity to the light string 1 via the control chip 6 so that the light string is powered to give out lights. Also, the control chip 6 may control the duration which the light string 1 gives out lights. The control chip 6 is a commonly available control chip.

During installation, the transparent wire 3 starts to twine the decorative flowers 2 at the periphery first, and then twine the rest of the decorative flowers 2 in orderly sequence so that the transparent wire 3 will not tangle, and each of the LED light beads 4 are ensured to be positioned at a center of a respective decorative flower. Also, the force applied for twining the transparent wire around the decorative flowers 2 should be sufficient to securely position each of the LED light beads at the center of a respective decorative flower without loosing.

In the present invention, the decorative flowers can be made of plastics, metals or glasses. In fact, the decorative flowers can also be made of any commonly available materials.

The above embodiment and drawing(s) are not intended to limit the forms and shapes of the present invention. Any adaptive changes or modifications made by a person skilled in this field of art should also fall within the scope of the present invention.

What is claimed is:

1. A solar decorative light, comprising decorative flowers and a light string; the decorative flowers are plural in number; the light string comprises a transparent wire and multiple LED light beads; the transparent wire connects the LED light beads in series; wherein the transparent wire twines the decorative flowers, with each of the LED light beads being positioned on a surface of a respective decorative flower; each of the decorative flowers has a plurality of petals, each of the petals has a gap therebetween, the transparent wire is wound at the gap between different petals, and the corresponding LED light bead is just located on an outer surface of the corresponding decorative flower;

the solar decorative light also comprises a solar battery panel and a storage cell; the polar battery panel is mounted outside of the decorative flowers; an output end of the solar battery panel is electrically connected with an input end of a control chip; an output end of the control chip is electrically connected with the light string; the control chip and the storage cell are bidirectionally electrically connected.

2. The solar decorative light as in claim 1, wherein the decorative flowers are made of plastics, metals or glasses.

3. The solar decorative light as in claim 1, wherein the solar decorative light also comprises a shell for fixing the solar battery panel; the solar battery panel is mounted on an outer side surface of the shell; the storage cell and the control chip are mounted inside the shell.

* * * * *